US007131855B2

(12) United States Patent
Saitoh

(10) Patent No.: US 7,131,855 B2
(45) Date of Patent: Nov. 7, 2006

(54) CONNECTOR

(75) Inventor: Yasushi Saitoh, Mie (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/979,170

(22) Filed: Nov. 3, 2004

(65) Prior Publication Data

US 2005/0130482 A1 Jun. 16, 2005

(30) Foreign Application Priority Data

Nov. 5, 2003 (JP) ..... P2003-376175

(51) Int. Cl.
*H01R 13/627* (2006.01)

(52) U.S. Cl. ..... 439/357

(58) Field of Classification Search ..... 439/357, 439/852, 843, 845, 595, 597, 598
See application file for complete search history.

(56) References Cited

U.S. PATENT DOCUMENTS

| | | | | |
|---|---|---|---|---|
| 5,098,311 | A * | 3/1992 | Roath et al. | 439/295 |
| 5,520,545 | A * | 5/1996 | Sipe | 439/65 |
| 6,250,974 | B1 * | 6/2001 | Kerek | 439/843 |
| 6,375,506 | B1 * | 4/2002 | Saunders et al. | 439/607 |
| 6,520,811 | B1 * | 2/2003 | Mitani et al. | 439/852 |
| 6,676,448 | B1 * | 1/2004 | Kato et al. | 439/595 |
| 2004/0038580 | A1 * | 2/2004 | Clement | 439/346 |

FOREIGN PATENT DOCUMENTS

JP A 08-236207 9/1996

* cited by examiner

*Primary Examiner*—Chandrika Prasad
*Assistant Examiner*—Phuongchi Nguyen
(74) *Attorney, Agent, or Firm*—Oliff & Berridge, PLC

(57) ABSTRACT

A connector has a first connector and a second connector in which a sliding distance between a first terminal and a second terminal is within a range of contact area in a contact portion between the first terminal and a contact portion of the second terminal in a state where the second connector and the first connector are securely fitted together by contacting the contact portion of the second terminal with the first terminal.

6 Claims, 8 Drawing Sheets

CONNECTOR

BACKGROUND OF THE INVENTION

1. Field of the Invention

The present invention relates to a connector, and more particularly to a connector which prevents the connection reliability from being lower due to micro-seismic abrasion between the terminals under high vibration environments.

2. Description of the Related Art

Generally, when a wire harness for automobile is connected to another wire harness or the equipment apparatus provided in the automobile, a connector attached to a terminal of wire harness is fitted into a partner's connector. Usually, such a connection structure is one in which a female connector 1 having a female terminal 1*a* and a female housing 1*b* for accommodating this female terminal 1*a* and a male connector 2 having a male terminal 2*a* and a male housing 2*b* for accommodating this male terminal 2*a* are fitted together, as shown in FIG. 11 (refer to JP-A-8-236207). The female terminal 1*a* with the wire W crimped at the rear end is inserted into a cavity 1*c* of the female housing 1*b*, and kept from slipping off by an engagement structure of an elastic lance 1*d* and a lance bore 1*e*. In such engagement structure of the female terminal 1*a*, there is usually a certain clearance between the female terminal 1*a* and the cavity 1*c*, and between the female terminal 1*a* and the elastic lance 1*d*. This structure is the same for the male connector 2.

Also, the female connector 1 and the male connector 2 are fixed in an anti-slip state by engaging a lock claw 1*g* of a lock arm 1*f* elastically flexible provided on an outer face of the female housing 1*b* into an engagement frame 2*f* provided on an outer face of the male housing 2*b*. In this lock structure, both the connectors 1, 2 are locked by return operation, after the lock arm 1*f* overrides the engagement frame 2*f* to be elastically flexed with the base portion at a fulcrum at the time of fitting both the connectors 1, 2. There is a certain clearance in a state where both the connectors 1, 2 are fitted together. Moreover, there is a clearance due to dimensional precision at a fitted portion around the circumference of both the housings 1*b*, 2*b*. In this way, since there are clearances due to various factors in the state where both the connectors 1, 2 are fitted, the microseism occurs at the contact portion between the female terminal 1*a* and the male terminal 2*a* due to influence of vibration. Moreover, microseism occurs between the female terminal 1*a* and the male terminal 2*a* due to influence of temperature changes caused by differences in the thermal expansion coefficient of materials between both the housings 1*b*, 2*b* and the female terminal 1*a* and the male terminal 2*a*.

On the other hand, with the advent of smaller size, lighter weight, and higher output engine in recent years, the acceleration of engine vibration tends to further increase. If the connectors 1, 2 are exposed to the environments of high vibration and temperature changes for the long term, there is possibility that the wear remarkably progresses between the female terminal 1*a* and the male terminal 2*a* due to microseism.

SUMMARY OF THE INVENTION

To prevent the wear due to microseism between male and female terminals, it is necessary to eliminate the clearance in the lock portion of the male and female housings, the clearance between each terminal and the housing, and the clearance between outer faces of male and female housings in the state where the male and female connectors are fitted. However, to eliminate all those clearances, very severe dimensional precision and addition of securing member with another member such as screwing, pressing of spring member and special armoring member are required, causing various problems of an increased number of parts, an increased cost due to great increase in the number of assembling steps, lower workability, and restricted attachment space due to larger size of connector. Therefore, it was extremely difficult to take the measures for eliminating the above clearances.

The invention has been achieved in the light of the above-mentioned problems, and it is an object of the invention to provide a connector that satisfies the conditions that the contact portion of the terminal is not worn even if the microseism between the two terminals occurs to some extent.

In order to achieve the above object, according to a first aspect of the invention, there is provided with a connector including: a first connector including; a first terminal having an elastic contact piece; and a first housing which accommodates the terminal; and a second connector including; a second terminal inserted into the first terminal and contacted with a contact portion which projects on the elastic contact piece; and a second housing which accommodates the second terminal, wherein a sliding distance between the first terminal and the second terminal is smaller than a length of a contact area where the first terminal contacts the second terminal in case where the first connector and the second connector are securely fitted with the first terminal in contact with the contact portion of the second terminal.

With the first aspect of the invention, even if microseism occurs between the first terminal and the contact portion of the second terminal due to influence of vibration for the long term in the state where the first connector and the second connector are securely fitted, a gas tight face is left behind at the contact portion, because the slide distance is set within the range of contact area between the first terminal and the second terminal. Hence, the oxidation and abrasive wear are suppressed from occurring on this gas tight face, whereby the wear due to microseism between contact portions of the first and second terminals is remarkably decreased, and the connection reliability is maintained in the use for the long term.

According to a second aspect of the invention, the contact area is set in conformance to an emboss shape embossed on the elastic contact piece to form the contact portion.

With the second aspect of the invention, the emboss shape is formed according to the direction of microseism occurring between the first and second terminals, whereby the microseismic distance is easily set within the range of contact area.

Moreover, according to a third aspect of the invention, the maximal slide distance occurring between the second terminal and the first terminal is made within a range of the area of actual contact area in a direction along the fitting direction of the first connector and the second connector and a direction orthogonal to the fitting direction.

With the third aspect of the invention, even if the microseism occurs in any direction between the first and second terminals due to influence of vibration acting on two connectors, the gas tight face is secured at the contact portion between both the terminals. Hence, the wear due to microseism between the terminals is effectively suppressed.

BRIEF DESCRIPTION OF THE DRAWINGS

FIG. 6 is an explanatory view showing a progress status of wear of the terminal, in which

DETAILED DESCRIPTION OF THE PREFERRED EMBODIMENTS

Figure 1:
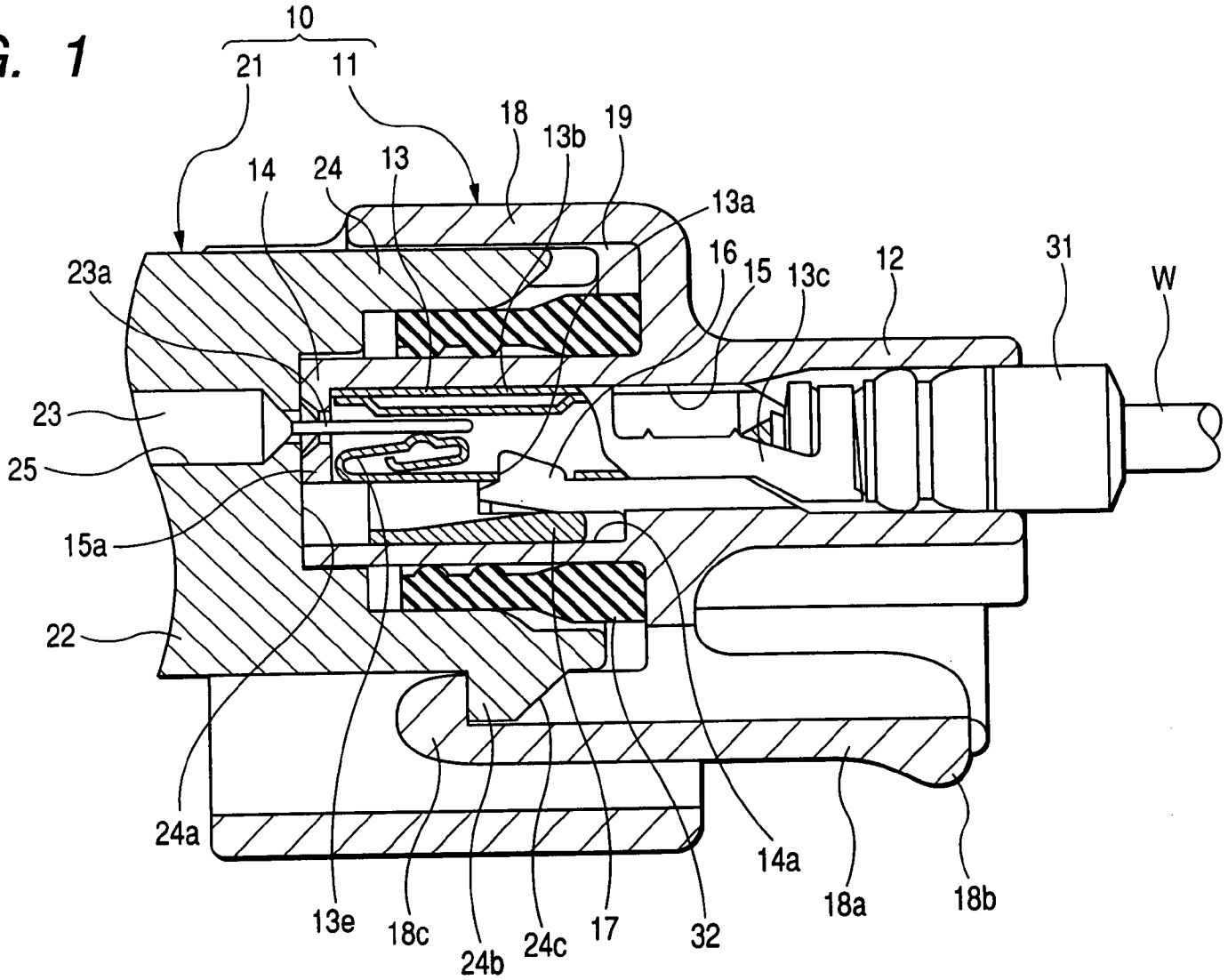
FIG. 1 is a cross-sectional view showing a connector according to an embodiment of the present invention.
Figure 2A:
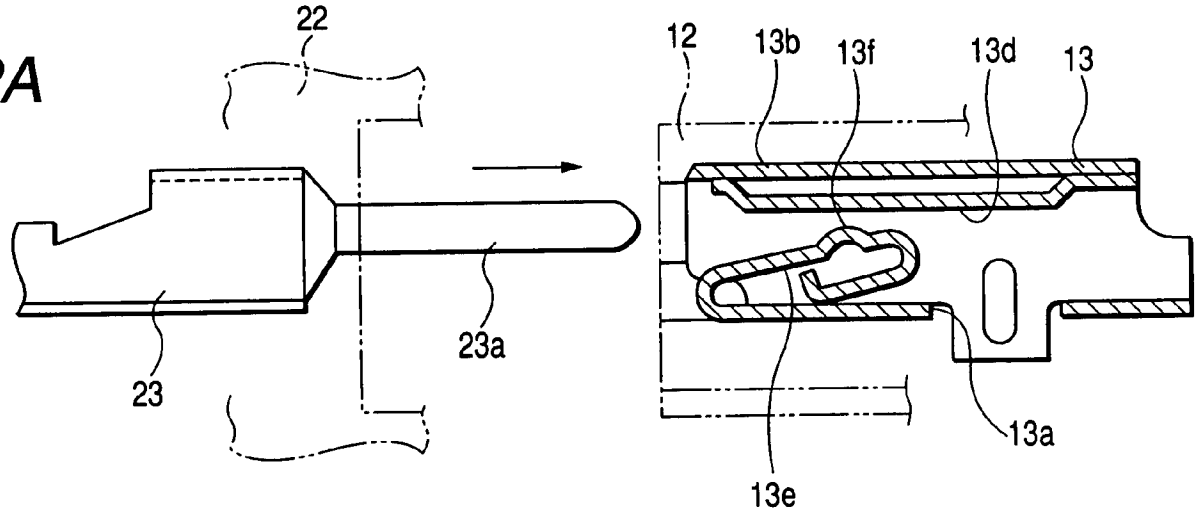
FIG. 2A is a cross-sectional view showing the parts in a state before a male connector and a female connector are fitted.
Figure 2B:
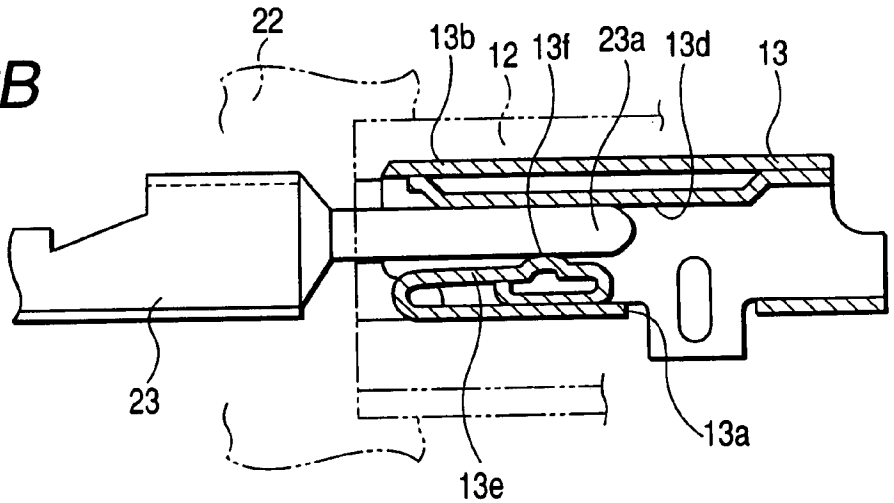
FIG. 2B is a cross-sectional view showing the parts in a state where they are fitted.

FIG. 1 shows the overall cross section of a connector according to an embodiment of the present invention, and FIGS. 2A and 2B show the detailed cross section of a terminal structure.

Hereinafter, the embodiment will be explained by referring a male or female type, but the present invention is not limited to the male or female connector.

This connector 10 is a water-proof type, and having a female connector 11 as a first connector and a male connector 21 as a second connector on the partner side, which are fitted together. The female connector 11 comprises a female housing 12 made of synthetic resin, and a female terminal 13 accommodated within the female housing 12, and the male connector 21 comprises a male housing 22 and a male terminal 23.

The female housing 12 is internally provided with a terminal receiving portion 14 fitted into a skirt portion 24 in the male housing 22, and the terminal receiving portion 14 is formed with a cavity 15 for receiving the female terminal 13. The female terminal 13 is inserted from behind the cavity 15, and prevented from slipping off by engaging an elastically flexible lance 16 projecting in cantilever form within the cavity 15 into a lance bore 13*a*. The female terminal 13 is regulated in terms of the position in the insertion direction by making the distal end part of the female terminal 13 contact with a front wall portion 15*a* of the cavity 15. Also, the female terminal 13 is engaged doubly by regulating flexure of the lance 16 after insertion of the female terminal 13 by a retainer 17 inserted into a flexible space 14*a* of the lance 16 in the terminal receiving portion 14.

The female terminal 13 is made of copper or copper alloy plated with tin, for example, and provided with a fitting portion 13*b* formed like a square column in the fore part, and capable of accepting a tab portion 23*a* of the male terminal 23, and a terminal part of a wire W and a water-proof rubber plug 31 armored around the wire W and intimately contacted with an inner wall of the cavity 15 are crimped with a barrel portion 13*c* in the rear part.

Also, the female housing 12 has a cylindrical hood portion 18 surrounding the terminal receiving portion 14 protruding in a fitting direction with the male housing 22. A fitting space 19 for accepting the skirt portion 24 of the male housing 22 is provided between an inner face of this hood portion 18 and an outer face of the terminal receiving portion 14, and a rubber ring 32 is attached around the circumference of the terminal receiving portion 14.

The male housing 22 is provided the cylindrical skirt portion 24 opened to the fore side, and an inner circumferential face of this skirt portion 24 is intimately contacted with an outer circumferential face of the rubber ring 32 to provide water-proof in a state where the male housing 22 and the female housing 12 are fitted. Also, the tab portion 23*a* of the male terminal 23 inserted into the cavity 25 from behind the male housing 22 projects from a depth wall 24*a* of the skirt portion 24. The male terminal 23 is securely engaged in anti-slip state by the lance and lance bore in the same way as the female terminal 13, which is not shown, and made of the same material as the female terminal 13, with an electric wire, not shown, connected at the rear end part.

Also, the hood portion 18 of the female housing 12 is provided with a lock arm 18*a* that is elastically flexible in the vertical direction. This lock arm 18*a* extends longitudinally in the fitting direction, and is moved vertically on the side of an engaging claw 18*c* projecting inwards at the distal end by operating the operation portion 18*b* at the rear end around a fulcrum in the center. On the other hand, an engagement projection 24*b* engaged by the engaging claw 18*c*, when fitted with the female housing 12, to keep the male housing 22 and the female housing 12 fitted projects on an outer surface of the skirt portion 24 for the male housing 22. At the distal end of this engagement projection 24*b*, a tapered guide face 24*c* is formed to guide the engaging claw 18*c* of the lock arm 18*a* in raised manner into an engaging position with the engagement projection 24*b*, when the female housing 12 and the skirt portion 24 are fitted.

The constitution for connecting the female terminal 13 and the male terminal 23 will be described below in detail. As shown in FIG. 2, within the fitting portion 13*b* of the female terminal 13, a fixing contact portion 13*d* is provided on a lower face of a top panel portion, and an elastic contact piece 13*e* opposed to the fixing contact portion 13*d* with a predetermined initial clearance is provided above the bottom wall portion. This elastic contact piece 13*e* is formed like a tongue by folding a plate member linked to a front end of the bottom wall portion of the fitting portion 13*b* obliquely upwards, and the contact portion 13*f* bulging toward the fixing contact portion 13*d* is formed on its upper face. This contact portion 13*f* is formed by circularly embossing the elastic contact piece 13*e*. Also, the initial clearance between the contact portion 13*f* and the fixing contact portion 13*d* is set to be narrower than the thickness of the tab portion 23*a* of the male terminal 23, in which the tab portion 23*a* is inserted between this contact portion 13*f* and the fixing contact portion 13*d* to push the elastic contact piece 13*e* toward the bottom wall side, so that the contact portion 13*f* is elastically pressed against the tab portion 23*a*.

The female connector 11 and the male connector 21 with the above constitution the tab portion 23*a* of the male terminal 23 and the contact portion 13*f* of the female terminal 13 are contacted and electrically connected in a state where the female housing 12 and the male housing 22 are securely fitted by lock member having the lock arm 18*a* and the engagement projection 24*b*. At this time, though the female terminal 13 and the female housing 12 are engaged by the lance 16 and the lance bore 13*a*, there is a certain clearance between both. Similarly, there is a certain clearance between the male terminal 23 and the female clearance 22. Also, there is a certain clearance between the lock arm 18*a* and the engagement projection 24*b* in the female housing 12 and the male housing 22. Moreover, there is a certain clearance circumferencially between the hood portion 18 and the skirt portion 24. These clearances cause the female terminal 13 and the male terminal 23 to slide relatively in a direction orthogonal to the fitting direction. Also, the female terminal 13 and the male terminal 23 slide with each other due to differences in the thermal expansion coefficient of materials between the female terminal 13 and the male terminal 23, and between the female housing 12 and the male housing 22.

And in the connector 10 of the invention, assuming that X is a component of slide distance in the fitting direction and Y is a component of slide distance in the direction orthogonal thereto, when the relative sliding between the female terminal 13 and the male terminal 23 is maximized by a total of elements causing the sliding, the following conditions are satisfied. That is, the slide distance (X, Y) is set within the range of contact area A between the tab portion 23*a* and the contact portion 13*f*, when the tab portion 23*a* of the male terminal 23 is contacted with the contact portion 13*f* of the female terminal 13 in the state where the female connector 11 and the male connector 21 are securely fitted.

Figure 3:
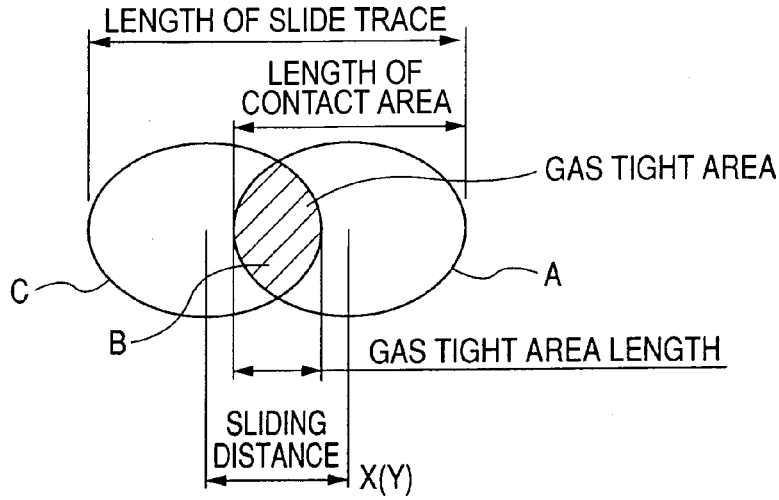
FIG. 3 is an explanatory view showing the conditions for realizing the connector of the invention.

FIG. 3 is an explanatory view showing the conditions for realizing the connector of the invention.

In FIG. 3, in the contact area A, a portion not exposed to the atmosphere by sliding, or a gas tight face B, is suppressed from producing the oxidation and abrasive wear, and kept in the excellent contact state. Accordingly, the stable connection is obtained in a range where the gas tight face is left behind. Thus, the relation for providing the stable connection is geometrically derived in the following.

$$\text{Slide trace} = \text{contact area} + \text{slide distance}$$

$$\text{Slide trace} = 2 \times \text{contact area} - \text{length of gas tight face}$$

$$\begin{aligned}\text{Length of gas tight face} &= 2X \text{ contact area} - \text{slide trace}\\ &= 2X \text{ contact area} - (\text{contact area} + \text{sliding distance})\\ &= \text{contact area} - \text{sliding distance}\end{aligned}$$

Hence, length of gas tight face>0, when length of contact area−sliding distance>0 namely, length of contact area>sliding distance

Figure 4A:
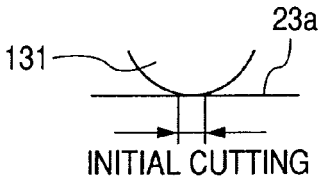
FIGS. 4A and 4B are explanatory views showing a progress status of wear of the terminal.
Figure 4B:
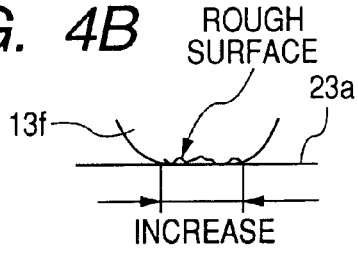
Figure 5:
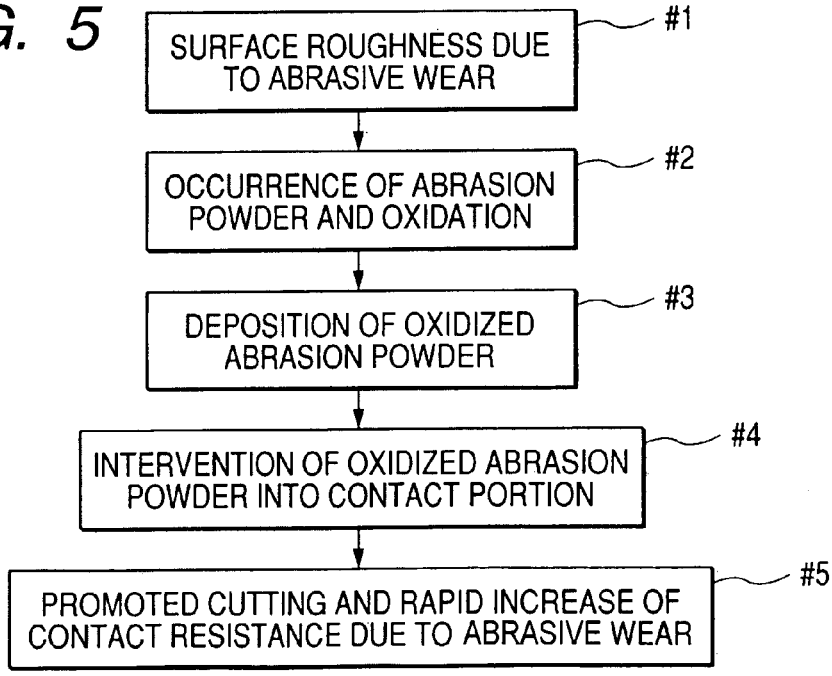
FIG. 5 is a block diagram showing a progress process of wear in the connector of the invention.

FIGS. 4 and 5 show the progress process of wear. Referring to FIGS. 4 and 5, a basic mechanism of micro-seismic abrasion deterioration in the terminals 12, 23 will be described below.

When the tab portion 23*a* of the male terminal 23 is fitted into the fitting portion 13*b* of the female terminal 13, and the contact portion (contact portion 13*f*) between the elastic contact piece 13*e* of the female terminal 13 and the tab portion 23*a* is subject to an expansion force caused by difference in the thermal expansion coefficient of materials when an external force such as vibration or a thermal gradient is applied, a microseism occurs at the contact portion. Then, a surface roughness due to abrasive wear of tinning occurs and the rough surface is increase (#1), as shown in FIGS. 4A and 4B. Then, abrasion powder is produced, and then oxidized on a non-gas tight face C exposed to the atmosphere by sliding in FIG. 3 (#2). The oxidized abrasion powder is deposited (#3), and intervenes between the contact portions (#4). And the cutting is promoted by the abrasive wear caused by grinding of oxidized abrasion powder and the corrosion wear caused by exfoliation of oxides, rapidly increasing the contact resistance (#5).

Figure 6A:
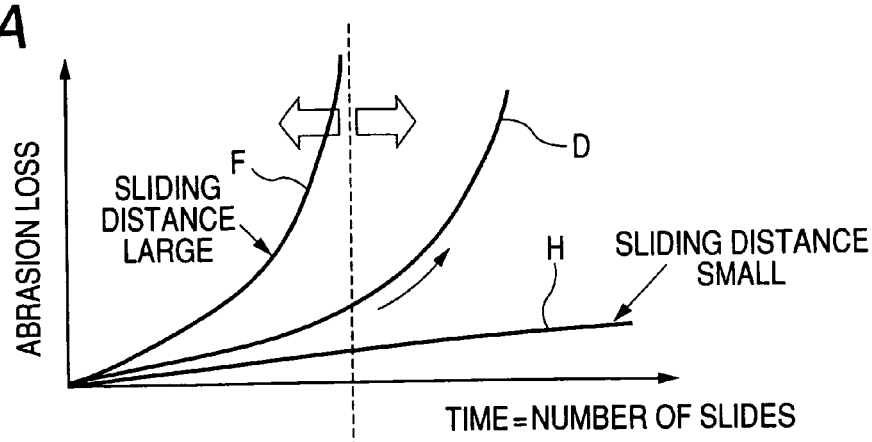
FIG. 6A shows the relationship between wear amount and time.
Figure 6B:
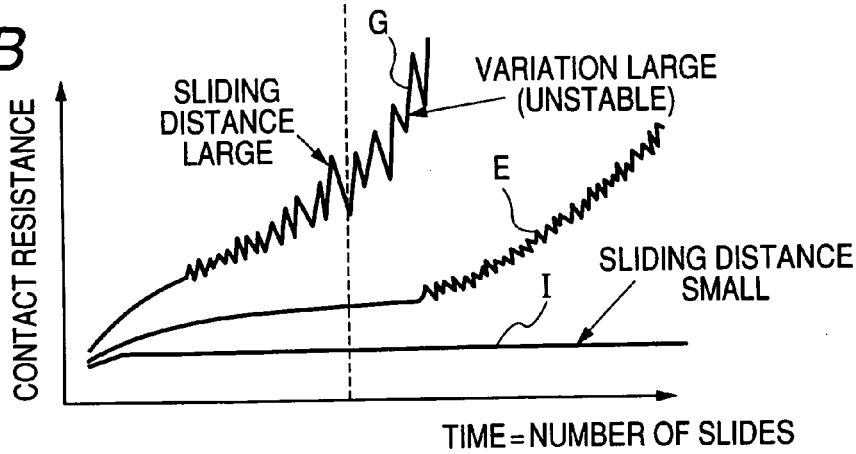
FIG. 6B shows the relationship between contact resistance and time.

FIG. 6 shows the behavior of wear. In FIG. 6A, the longitudinal axis indicates the abrasion loss, and the transverse axis indicates the time (=number of slides). Also, in FIG. 6B, the longitudinal axis indicates the contact resistance, and the transverse axis indicates the time (=number of slides). As indicated by curve Din FIG. 6A, the abrasive wear occurs at first, but an increase in the abrasion loss is gentle in an occurrence area of the abrasive wear, and a decrease in the contact resistance is small, as indicated by curve E in FIG. 6B. And the abrasive wear and the corrosion wear occur successively, but progress relatively rapidly in the occurrence areas of these wears, whereby the contact resistance is increased very abruptly and varied, resulting in an unstable state, as indicated by curve E in FIG. 6B.

Also, when the sliding distance is large, the gas tight face B is very small, or not formed at all, so that the oxidized abrasion powder is remarkably produced. As indicated by curve F in FIG. 6A, the phase transfers to the area of abrasive wear and corrosion wear at the earlier stage than in curve D, and the extent of wear is large. At this time, the contact resistance is changed to have higher resistance from the early stage, with large variations, resulting in a remarkably unstable state, as indicated by curve G in FIG. 6B, On the other hand, when the slide resistance is small, most of the contact area A is kept on the gas tight face B, whereby the oxidation is prevented, and the production of oxidized abrasion powder is suppressed. Therefore, there is hardly an increase in the abrasion loss, as indicated by curve H in FIG. 6A, and there is a small change in the contact resistance with the passage of time, whereby the stable state is kept, as indicated by curve I in FIG. 6B.

Figure 6C:
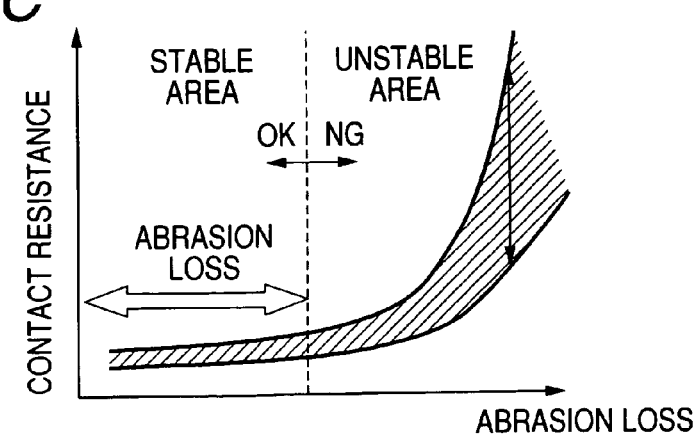
FIG. 6C shows the relationship between contact resistance and wear amount.
Figure 7A:
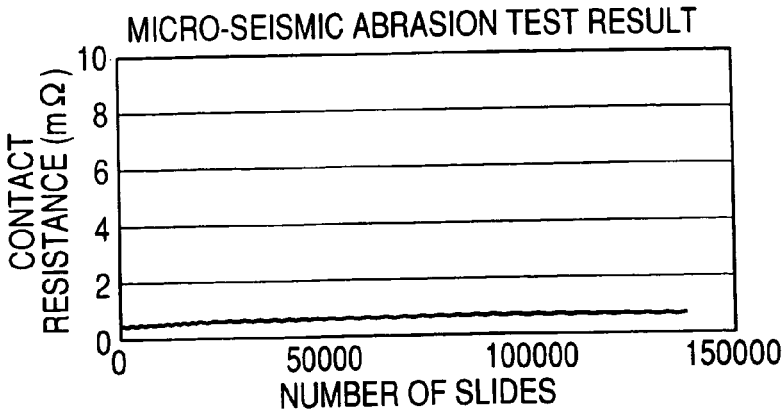
FIG. 7A to 7D are a set of charts showing the micro-seismic abrasion test results of the terminal.
Figure 7B:
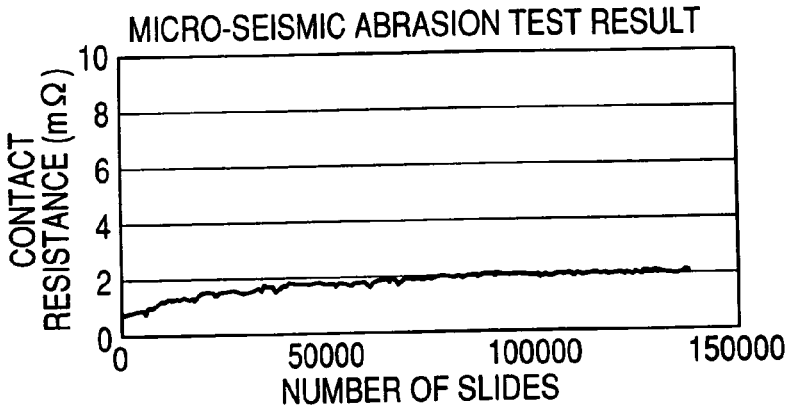
Figure 7C:
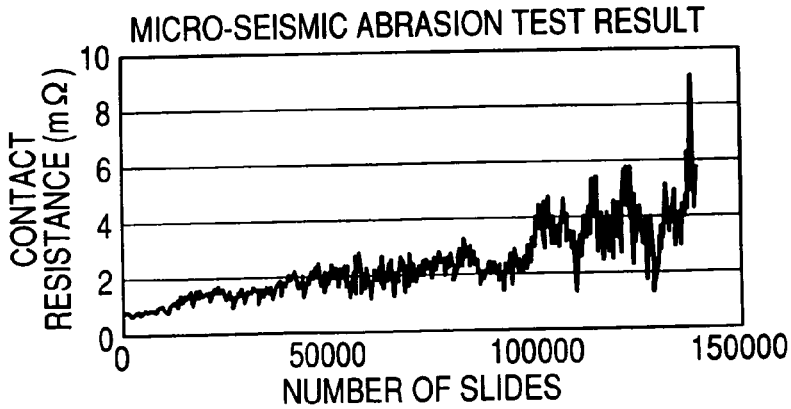
Figure 7D:
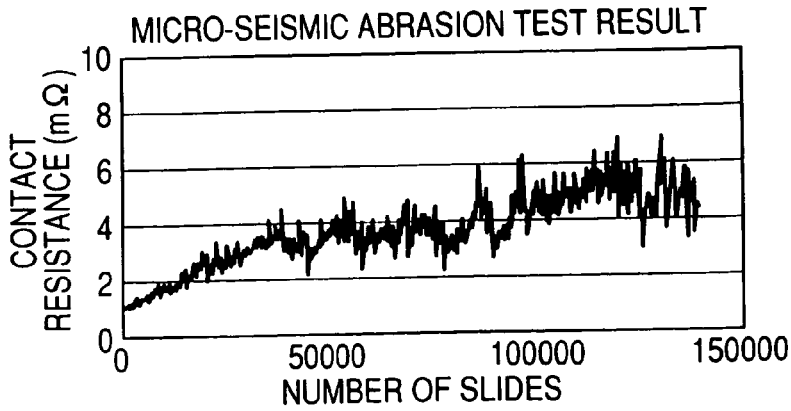

FIG. 6C is a combination of FIGS. 6A and 6B. In FIG. 6C, the longitudinal axis resistance the contact resistance, and the transverse axis represents the abrasion loss. In FIG. 6C, a stable area (permissible abrasion loss) where there is almost no increase in the contact resistance is obtained in an area where the abrasion loss is relatively small, while the contact resistance is remarkably high in proportion to the magnitude of abrasion loss in an area where the abrasion loss is large, resulting in an unstable area. Moreover, the contact resistance is remarkably high, with the variation width increased, in an area where the abrasion loss is remarkably large, resulting in a further unstable state.

Thereby, to suppress the progress of wear, it is effective to suppress the occurrence of oxidized abrasion powder and intervention into the contact portion and prevent the progress of abrasive wear.

FIG. 7 shows the micro-seismic abrasion test results, in which the longitudinal axis represents the contact resistance (mo) and the transverse axis represents the number of slides. In the test conditions, the female terminal and the male terminal were left away at high temperatures in the fitted state, and then subject to microseism in the fitted state. The vibration frequency was 20 Hz, and the number of slides was about 140,000. In FIG. 6, the sliding distance between terminals is 0.05 mm in (a), 0.15 mm in (b), 0.25 mm in (c), and 0.75 mm in (d), and the contact area is as large as 0.20 mm in any case.

From the test results, it was verified that when the sliding distance between male and female terminals is larger than the contact area (see FIGS. 7*c* and 7*d*), the contact resistance is increased and greatly varied to make the connection unstable, while when the sliding distance is smaller than the contact area (see FIG. 7*b*), the connection is stable near a contact resistance of 2 mΩ. Furthermore, when the sliding distance is smaller (see FIG. 7*a*), there is almost no increase in the contact resistance, whereby the characteristic is very stable at 1 mΩ or less.

Figure 8:
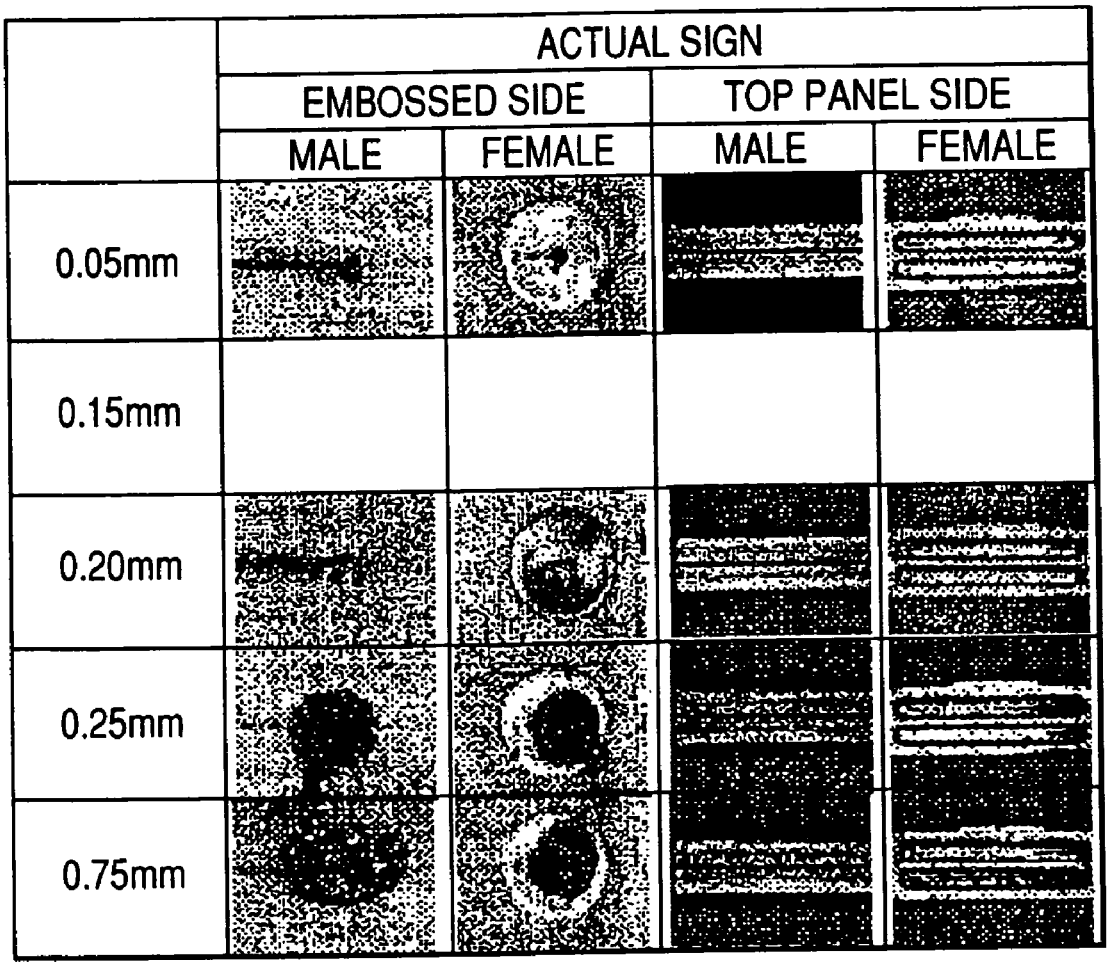
FIG. 8 is a view showing the surface state of a contact part between the male and female terminals.

FIG. 8 shows a surface state of the contact portion between female terminal and male terminal in the above micro-seismic abrasion test, in which the male and female (lower part of the tab portion 23*a* and contact portion 13*f* in FIG. 2) with emboss side, and the male and female (upper face of the tab portion 23*a* and fixing contact portion 13*d* in FIG. 2) on the top panel plate side are shown for each set-up sliding distance. From this figure, the wear is very small in a range where the sliding distance between male and female terminals is smaller than the contact area, while if the sliding distance is larger than the contact area, the wear is rapidly increased.

Figure 9A:
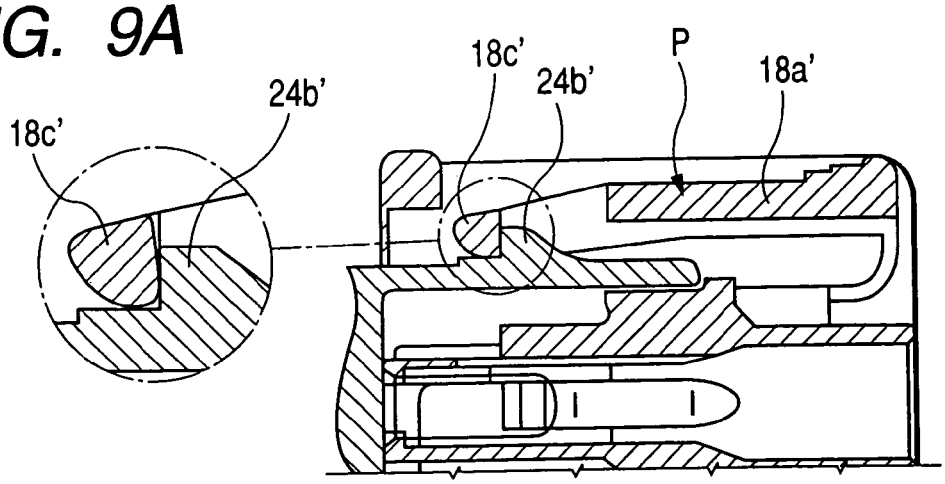
FIGS. 9A to 9C are views showing an example of clearance reduction measure at each part in the connector.
Figure 9B:
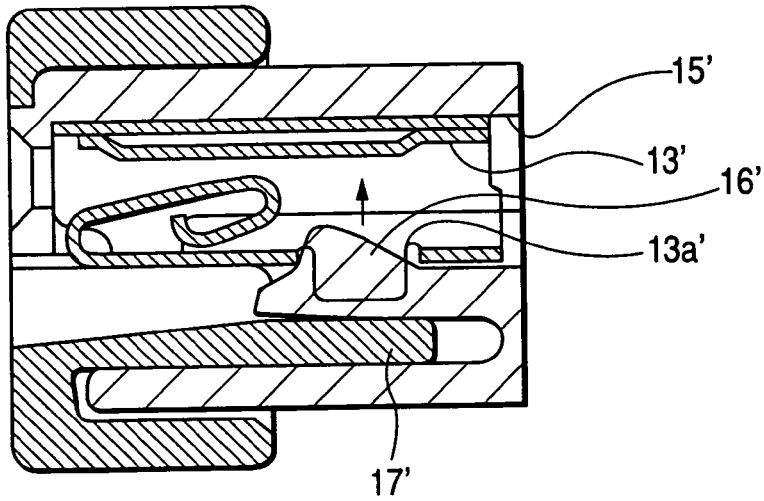
Figure 9C:
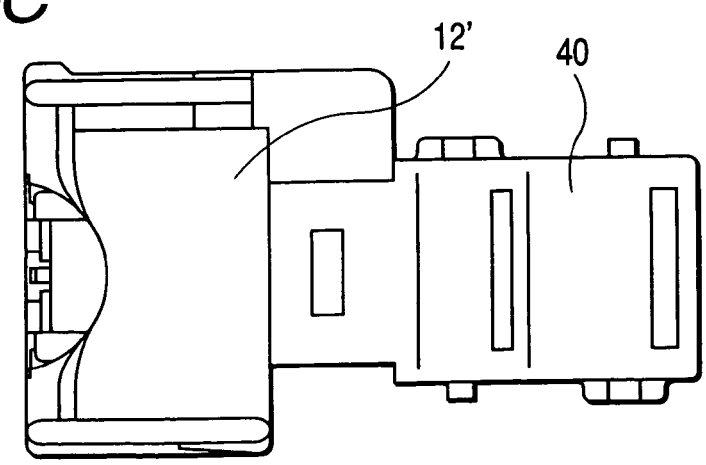

The range of contact area A is obtained by measuring the contact area at the time of fitting in the experiment, or from the embossed shape, using a well-known Hertz expression. When a constant load is applied between the male and female terminals, the contact area takes a fixed value. On the other hand, the sliding distance is a total of clearances between members, as previously described, and set within a range of contact area A by regulating the factors of causing those clearances. To regulate the sliding distance between the male and female terminals, lock member based on the engagement between a lock arm 18*a*' and an engagement projection 24*b*' has the position of rotation fulcrum P of the lock arm 18*a*' shifted outwards from the position of the engagement portion, so that the engaging claw 18*c*' gnaws into the engagement projection 24*b*', as shown in FIG. 9A. Thereby, the clearance in the lock portion is reduced. Also, a lance 16' is forcefully pushed inside by a retainer 17' to reduce the clearance with a lance bore 13*a*' and between a female terminal 13' and a cavity 15', as shown in FIG. 9B. Moreover, it is possible to reduce the microseism of the female terminal 13' following the deflection of wire W by attaching a cleat cover 40 for making the wire W steady at the rear end part of a female housing 12', as shown in FIG. 9C. These measures may be also applied on the male connector side 21.

In this way, various measures may be taken to reduce the sliding distance between male and female terminals. In this invention, to eliminate the sliding distance completely, it is unnecessary that each constituent member is fully fixed, and the sliding distance is set in the range of contact area.

Figure 10:
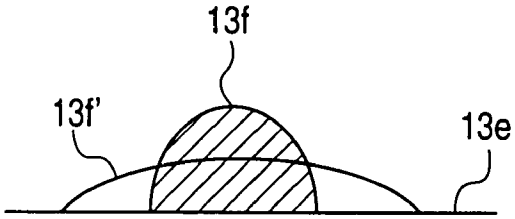
FIG. 10 is a typical view of a variation of emboss shape at a contact portion of the female terminal.
Figure 11:
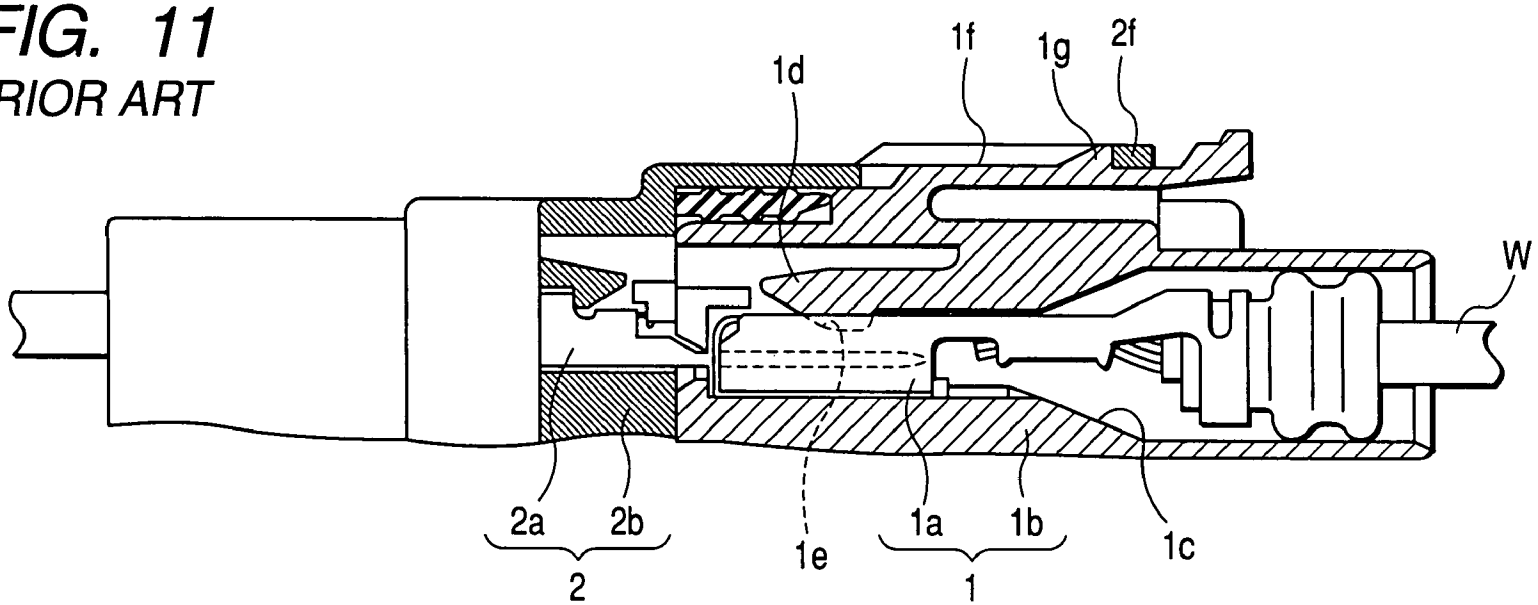
FIG. 11 PRIOR ART
FIG. 11 is a view showing a conventional typical connector.

Also, if the emboss shape of the contact portion 13*f* of the elastic contact piece 13*e* in the female terminal 13 is set to have a gently curved surface as indicated by 13*f*', the range of contact area A with the tab portion 23*a* of the male terminal 23 is extended, whereby the setting conditions of the sliding distance within the range of contact area A can be relieved, as shown in FIG. 10. Moreover, since the friction resistance with the male terminal 23 is small in this case, it is possible to provide a less abrasive situation.

Though in the above embodiment, the sliding between male and female terminals occurs in one direction in FIG. 3, it is necessary to satisfy such a relation that the sliding distance is likewise within the range of contact area in a direction orthogonal to the illustrated direction. That is, when the micro sliding between male and female terminals occurs in a direction parallel to the fitting direction of the male and female connectors and a direction orthogonal thereto, it is necessary to satisfy the condition that the sliding distance is included within the range of contact area in both directions. On the other hand, in a situation where no sliding in one direction occurs with the clearance measure for each portion, it is necessary to satisfy the relation with the contact area only for the sliding distance in the other direction.

Also, though in the above embodiment, the constitution of the typical connector in which the male terminal 23 on the side of the male connector 21 is engaged by the lance has been described, the connector may be of the type in which the male terminal is fully fixed to the male housing by press fitting or molding, like an apparatus direct coupled connector or a PCB connector. In this case, there is no micro sliding of the male terminal between the male terminal on the male connector side and the male housing, which is beneficial to other clearance adjustments.

Also, though the water-proof type connector is illustrated in the above embodiment, the invention is also applicable to the typical connector without water-proof treatment. The number of male and female terminals may be one or more.

What is claimed is:

1. A connector comprising:

a first connector including;

a female terminal having an elastic contact piece, the elastic contact piece including a gas tight face for contacting a male terminal; and a female housing which accommodates the female terminal; and a second connector including;

a male terminal to be slidably inserted into the female terminal and contacted with the female terminal over a contact area including at least the gas tight face; and a male housing which accommodates the male terminal, wherein, after the male housing and the female housing have been securely fitted together, a sliding distance between the male terminal and the female terminal is smaller than a length of an area of actual contact between the male terminal and the female terminal in a state of complete engagement between the male housing and the female housing, such that at least the portion of the contact area including the gas tight face is not exposed to a surrounding atmosphere as a result of sliding and vibration between the male terminal and the female terminal in the state of complete engagement.

2. The connector according to claim 1, wherein the area of actual contact is the gas tight face which comprises an emboss shape embossed on the elastic contact piece to form the contact portion.

3. The connector according to claim 1, wherein the sliding distance between the female terminal and the male terminal is made within a range of the area of actual contact in a direction along a fitting direction of the first connector and the second connector and a direction orthogonal to the fitting direction.

4. A connector comprising:

a first connector including;

a first terminal having an elastic contact piece, the elastic contact piece including a gas tight face for contacting a second terminal; and a first housing which accommodates the first terminal; and a second connector including;

a second terminal to be slidably inserted into the first terminal and contacted with the first terminal over a contact area including at least the gas tight face; and a second housing which accommodates the second terminal, wherein, after the first housing and the second housing have been securely fitted together, a sliding distance between the first terminal and the second terminal is smaller than a length of an area of actual contact between the first terminal and the second terminal in a state of complete engagement between the first housing and the second housing, such that at least the portion of the contact area including the gas tight face is not exposed to a surrounding atmosphere as a result of sliding and vibration between the first terminal and the second terminal in the state of complete engagement.

5. The connector according to claim 4, wherein the area of actual contact is the gas tight face which comprises an emboss shape embossed on the elastic contact piece to form the contact portion.

6. The connector according to claim 4, wherein the sliding distance between the second terminal and the first terminal is made within a range of the area of actual contact in a direction along a fitting direction of the first connector and the second connector and a direction orthogonal to the fitting direction.

* * * * *